United States Patent [19]

Walig

[11] 3,983,734

[45] Oct. 5, 1976

[54] METHOD OF AND APPARATUS FOR SHAPING METAL BILLETS

[75] Inventor: Herbert Walig, Sulzbach-Rosenberg, Germany

[73] Assignee: Eisenwerk-Gesellschaft Maximilianshutte mbH, Sulzbach-Rosenberg, Germany

[22] Filed: May 12, 1975

[21] Appl. No.: 576,484

[30] Foreign Application Priority Data

May 21, 1974 Germany ..... 2424587

[52] U.S. Cl. ..... 72/214

[51] Int. Cl.² ..... B21B 1/00

[58] Field of Search ..... 72/214, 199, 240, 366, 72/365, 256, 270, 206; 29/526.3, 187, 187.5; 164/70

[56] References Cited

UNITED STATES PATENTS

| | | | |
|---|---|---|---|
| 2,432,566 | 12/1947 | Findlater | 72/209 |
| 2,701,976 | 2/1955 | Krause | 72/235 X |
| 2,963,071 | 12/1960 | Krynytzky | 72/163 X |
| 3,492,918 | 2/1970 | Michelson | 164/70 X |
| 3,606,785 | 9/1971 | Olsson | 29/526.3 X |

*Primary Examiner*—Milton S. Mehr
*Attorney, Agent, or Firm*—Lawrence I. Field

[57] ABSTRACT

A method of shaping the external surface of a metal billet which comprises holding the billet stationary and moving a pair of grooved rolls which are idly rotatably supported over the billet so that the billet passes through a gap between the rolls and guiding the paths of the rolls to provide the billet with the required shape. This method is preferably carried out by apparatus which comprises a pair of grooved rolls which are idly rotatably supported with a gap between them, means for holding the billet stationary, a mechanism for moving the rolls to cause them to pass along a billet held by the holder so that the billet passes through the gap between the rolls, and at least one guide track for each roll for guiding the path of the roll as it is moved by the mechanism. Preferably each grooved roll is supported on a shaft which extends axially beyond the ends of the roll and two runner rolls, each of which runs along a guide track as the grooved roll is moved, are mounted on the ends of the shaft. The guide tracks of the two rolls are preferably movable relatively to each other to adjust the paths of the grooved rolls and thus adjust the shape to which the billet is shaped.

5 Claims, 3 Drawing Figures

METHOD OF AND APPARATUS FOR SHAPING METAL BILLETS

This invention relates to methods of and apparatus for shaping metal billets, for example billets intended for the manufacture of seamless tubes.

In the manufacture of seamless tubes, for example by the push-bench process, four-sided billets are generally used. Four sided billets are relatively simple to roll and such billets or ingots can be made very economically in continuous casting plants.

The manufacture of a tubular hollow body starts with the cutting to the desired length of, for instance, a continuously cast four-sided ingot to form a billet. This billet is then deformed in a punching press to form a hollow cylinder closed at one end. The making of this sleeve-shaped intermediate product is of the utmost decisive importance for the manufacture of seamless tubes on a push-bench, with regard to the quality of the tube blank resulting therefrom.

When manufacturing the hollow cylinder in the punching press, central punching is of extreme importance, that is punching without deviation of the punching mandrel towards the edge of the billet. If the punching is not effected with sufficient accuracy, a tube blank of uniform wall thickness cannot be made in the subsequent drawing operation on the push-bench. A decisive requirement for the subsequent further processing of the tube blank, for example in a cold drawing plant, is however that it shall have a uniform wall thickness.

Some proposals have already been made for preworking four-sided billets in a manner such as make them suitable for use in a punching press and thus for increasing the yield of faultless hollow cylinders and also further reducing any eccentricity of punching. In these proposals, the four-sided billets, before they are inserted into the punching press, are given a conicity corresponding to a conicity of the press die. The female die of the punching press has a slightly conical shape, in order to facilitate removal from the die of the resulting hollow cone section, after it has been formed.

There is also an existing billet shaping apparatus which, by means of two eccentrically journalled, mutually facing grooved rolls, imparts the desired conicity to the external edges of the billet as the four-sided billet passes between the rolls. The drive of the eccentrically journalled rolls is effected intermittently by racks and pinions, and the four-sided billet is advanced synchronously with the rotation of the rolls by means of a rack feed. This device does however have some disadvantages: in the first place the drive is very complicated and permits billets of only one length to be shaped by a particular pair of rolls. Whenever the billet length changes, the rolls and feed rack must be changed to suit the new billet length. In addition, it is not possible with this shaping apparatus to obtain a linearly exact conicity and to impart a specific shape to the end of the billet. In the manufacture of tubes it has however been found important to give an approximately circular shape to the conical initially four-sided billet at its end of larger cross-section. This enables undesirable jagged tube ends to be avoided when working such billets to produce tube blanks.

Apart from the aforementioned disadvantages, the shaping apparatus mentioned above can only be set to a new conicity by changing the rolls. Either the eccentricity of the rolls is changed, or the rolls are given a complicated, nonrotationally symmetrical grooving.

The aim of this invention is to provide a method of and an apparatus for the conical deformation of four-sided billets, which apart from obtaining a linear conicity of the four-sided billet also makes possible deformation of one end of the billet to an approximately circular cross-section. It is also desirable that the shaping apparatus should be capable of permitting simple adjustment of the conicity and of operating largely independently of the billet length. It should also be easily adjustable to differing billet dimensions.

According to one aspect of the invention, in a method of shaping a metal billet, the billet is held stationary and grooved idler rolls which are rotatably supported are moved along guided paths over the billet, the billet passing through a gap between the rolls.

According to another aspect of the invention, apparatus for carrying out the method in accordance with the invention comprises at least two grooved idler rolls which are rotatably supported with a gap between them, means for holding the billet stationary, a mechanism for moving the rolls to cause them to pass along a billet held by the holder so that the billet passes through the gap and at least one guide track for each roll for guiding the path of the roll as it is moved by the mechanism.

Apart from great economy resulting from the simple, strong construction of this apparatus and the consequent reliability in operation, this apparatus has further advantages which cannot be achieved with the apparatus hitherto known. In particular, it comprises normal rotationally symmetrical rolls without any driving mechanism. Since the rolls are thus simple to make, their calibration or grooving can be easily altered and it is possible to provide the billet being deformed with shapes other than conicity. For example, it has been found of advantage to turn the rolls to a concave section thereby forming rounded corners on four-sided billets, instead of providing rolls with internal flanks which are straight as seen in radial section, thus producing chamfered edges on the billets.

Preferably, the grooved rolls are mounted on shafts and are supported from the guide tracks by means of runner rolls mounted on the same shafts as the grooved rolls. By simply changing the inclination of the tracks relative to each other, for example by means of a hand operated adjustment, the conicity of the billet can be modified. Thus, for example, the conicity of a four-sided billet for the production of seamless tubing can be adjusted accurately to the conicity of the female die punching press.

In practice it has been found advantageous, as the female die of the punching press wears, to modify the conicity of the four-sided billet and adjust it accurately to the worn die. In this manner, a good seating of the billet in the die is obtained and the lateral deviation of the material in the die, during pressing, is obviated. The punching mandrel is guided axially and centrally during punching and thus an important prerequisite for the production of tubes of uniform wall thickness is satisfied.

The guide tracks may guide the grooved rolls along paths other than straight lines, the resultant shape thus being transmitted during rolling to the billet. In this manner, for example, non-linear conicities or conicities of differing angles can be given to the billet.

If a substantially linear conicity is desired and deviations in shape are only sought at particular points along the length of the billet, this can be achieved by mounting distance pieces on the guide tracks. It has, for instance, been found to be of advantage when producing blanks for the production of seamless steel tubes, to provide at the end of a billet of larger cross-section a more pronounced deformation departing from linear conicity.

The end portion of the billet then has a transition approximately into the shape of an inscribed circle in the four-sided section. This deformation of the billet end is achieved by two suitable distance pieces on the guide tracks of both grooved rolls.

Examples of a method and of a device in accordance with the invention will now be described with reference to the accompanying drawings in which.

Figure 1:
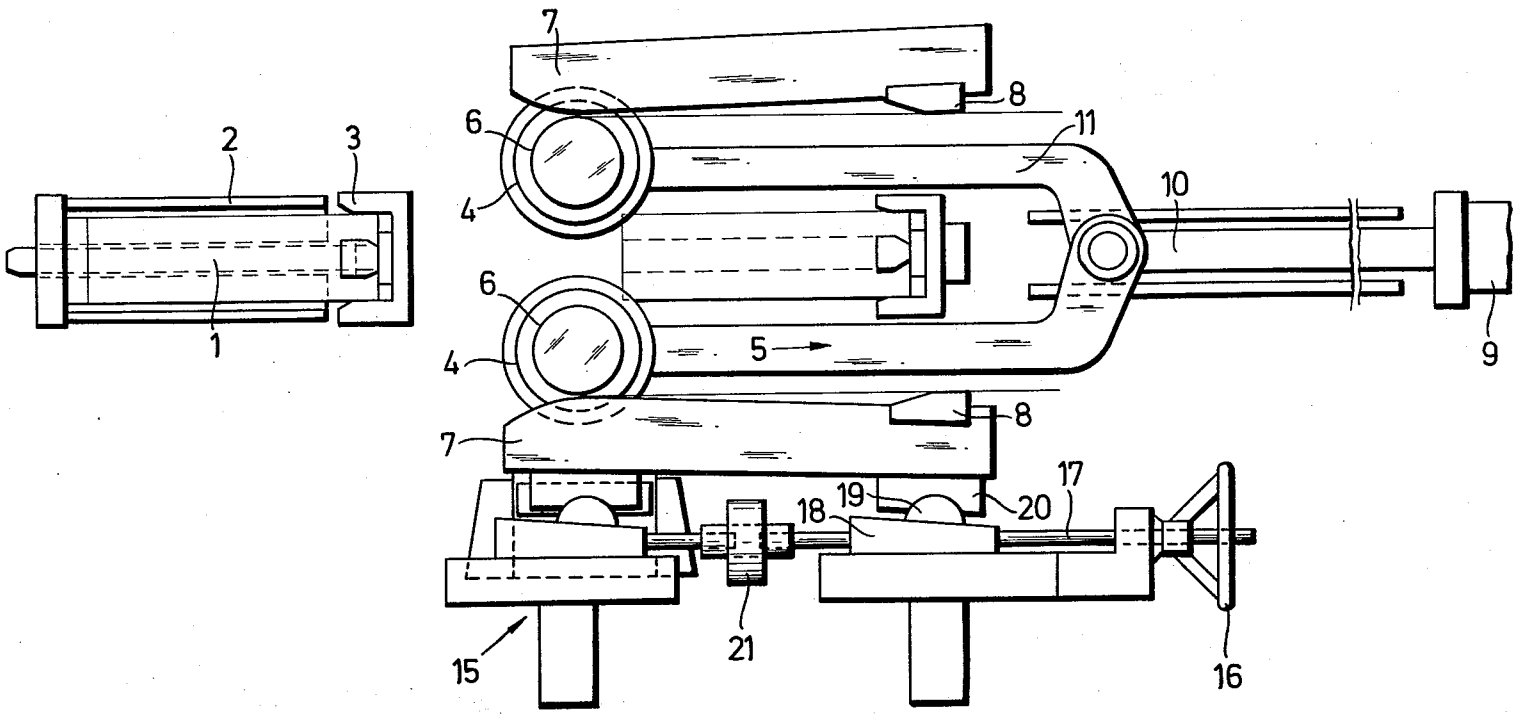
FIG. 1 is a somewhat diagramatic plan view of the device before rolling a billet.
Figure 2:
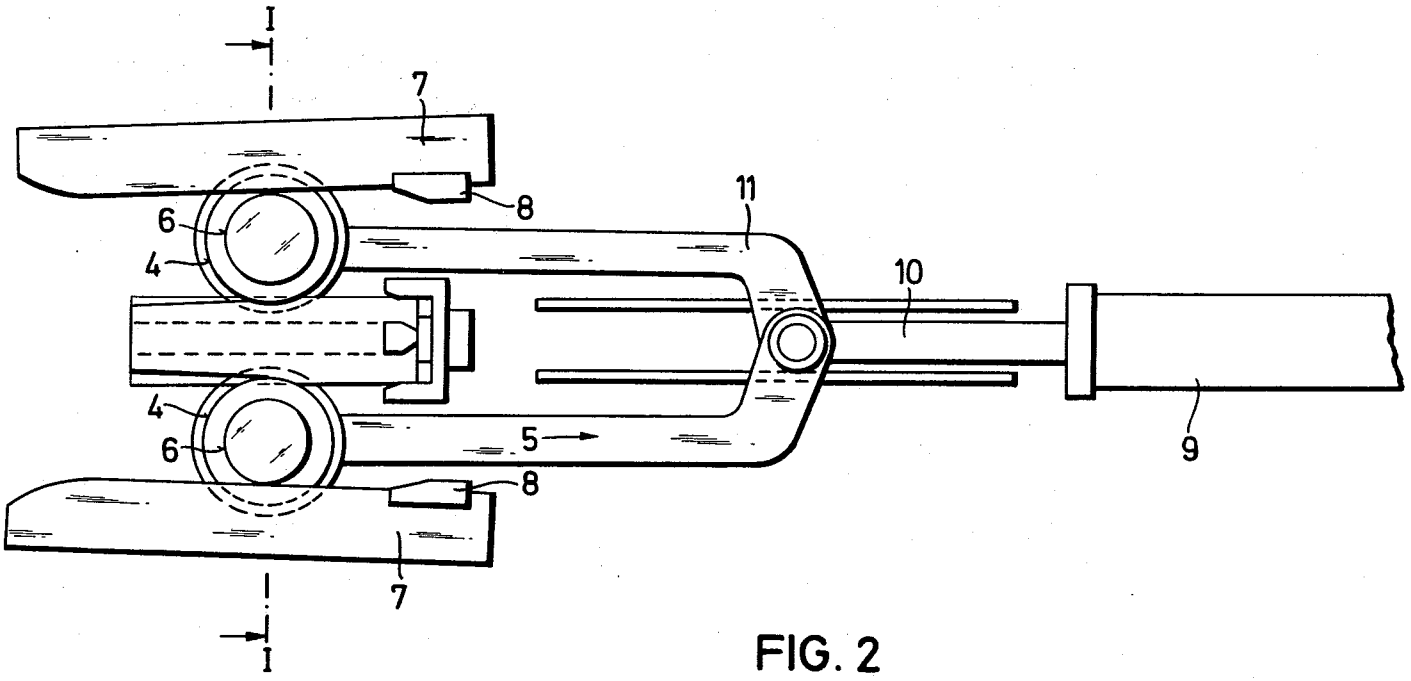
FIG. 2 is a plan view of the device, similar to part of FIG. 1, but during the rolling of a billet; and, FIG. 3 is a section through the rolling plane of the device along the line I—I in FIG. 2.
Figure 3:
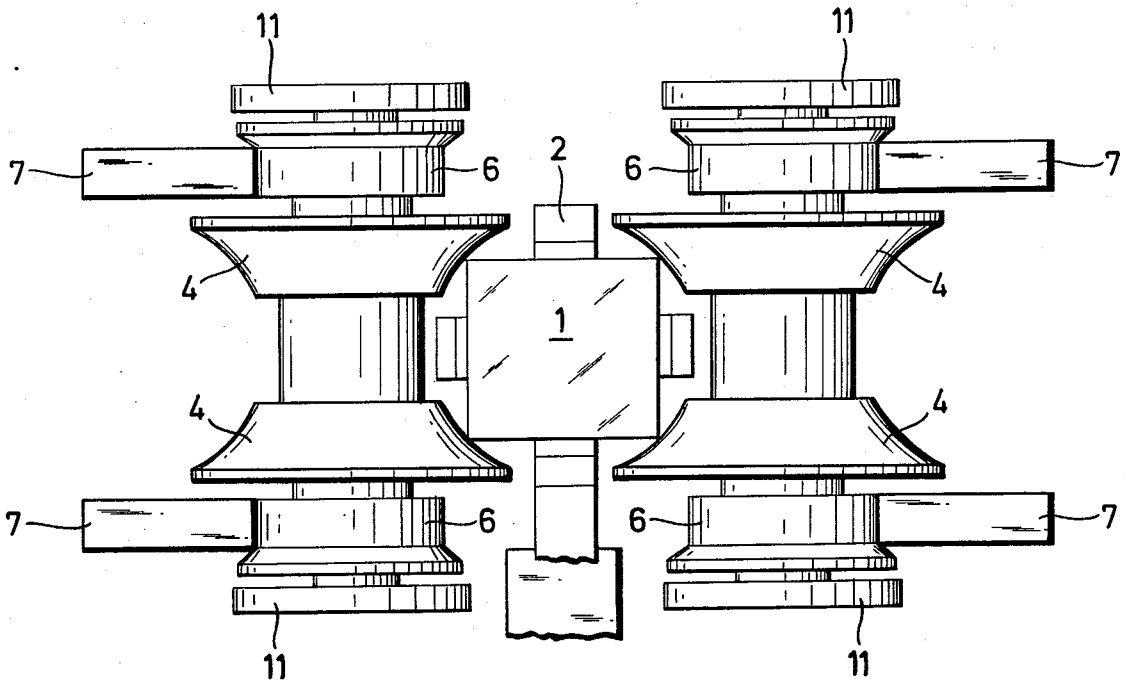

A preheated billet 1 is introduced by means of a feed device 2 comprising a holder 3 into the shaping device and is fixed in the correct position. The end of the billet which, after deforming has the larger cross-section is now situated in a fixed position by the holder 3. Rolls 4 are moved in the direction of an arrow 5 along the fixed billet 1. While they are so moving, the rolls 4 are guided by guide tracks 7 against which runner rolls 6 bear, the rolls 6 being mounted on the same shafts as the rolls 4. Distance pieces 8 are fitted to the guide tracks 7 to achieve the required end deformation of the billet 1.

The rolls are moved by a hydraulic cylinder 9 which acts through a piston rod 10 and a fork 11. The two prongs of the fork 11 are pivoted to the rod 10 and are connected to the shafts of the rolls 4 and 6.

The inclination of the tracks 7 can be changed in a very simple manner by means of an adjustment device 15, only part of which is shown. The adjustment device acts upon both the guide tracks 7 and can easily be set by a hand wheel 16 acting on a screw-threaded spindle 17. The hand wheel 16 serves for adjustment for the dimensions of the billet and a second hand wheel 21 adjusts the tracks 7 to alter the conicity of the billet. In the example illustrated the adjustment of the tracks 7 is effected by pulling wedges 18. On the upper surfaces of the pulling wedges half-cylinders 19 slide and the half-cylinders engage in corresponding recesses in counter-pieces 20. When the hand wheel 16 is turned, the two pulling wedges 18 move in the same direction, so that the associated guide track moves perpendicularly to the direction of motion of the billet 1. By rotation of the hand wheel 21 however, the distance between the two pulling wedges 18 is altered, so that the angle of inclination of the guide track 7 is altered and the conicity of the billet is adjusted.

The shaping device in accordance with the invention has the advantage of a simple construction which makes it robust and operationally reliable since it is insensitive, for example, to temperature changes and rough treatment.

I claim:

1. Apparatus for shaping a metal billet comprising:
means for holding said billet stationary while it is being shaped;
at least one pair of grooved rolls supported so as to be idly rotatable and so as to define a working pass between each said pair of rolls;
means for moving said rolls lengthwise of said billet whereby said billet is shaped as said rolls move along said billet;
at least one guide track for each roll of each said pair of grooved rolls;
means bringing said guide track into operative relation with said rolls; and
means for inclining said guide track relative to the principal longitudinal axis of said billet so as to cause the dimensions of said working pass to be varied as said rolls move lengthwise of said billet.

2. Apparatus as claimed in claim 1, further comprising a plurality of distance pieces and means mounting said distance pieces one on each of said guide tracks, said distance pieces comprising tapered surfaces whereby the end of said billet may be further deformed.

3. Apparatus as claimed in claim 1, wherein said means for inclining comprises pulling wedges, a common spindle, means threadably engaging said pulling wedges with said spindle, means for rotating said spindle to move said pulling wedges, counter-pieces movable by movement of said pulling wedges and means operatively fixing said counter-pieces to said guide tracks.

4. Apparatus as claimed in claim 3, wherein said spindle includes two coaxially arranged parts, screw-threads on adjacent ends of said parts and a hand wheel receiving said screw-threads on said ends, whereby rotation of said hand wheel moves said parts axially relative to each other.

5. Apparatus as claimed in claim 3, further comprising means defining part-cylindrical recesses in said counterpieces, and a plurality of half-cylinders, said half-cylinders having half-cylindrical surfaces fitting one in each of said recesses in said counter-pieces and diametral surfaces in sliding engagement with said pulling wedges.

* * * * *